United States Patent [19]

Rupp

[11] Patent Number: 4,478,560

[45] Date of Patent: Oct. 23, 1984

[54] FLUID-OPERATED RECIPROCATING PUMP

[75] Inventor: Warren E. Rupp, Mansfield, Ohio

[73] Assignee: The Warren Rupp Company, Mansfield, Ohio

[21] Appl. No.: 422,094

[22] Filed: Sep. 23, 1982

[51] Int. Cl.[3] ..... F04B 43/06

[52] U.S. Cl. ..... 417/393; 91/311; 91/314

[58] Field of Search ..... 91/311, 314, 316, 329; 417/393

[56] References Cited

U.S. PATENT DOCUMENTS

| | | | |
|---|---|---|---|
| 2,178,850 | 11/1939 | Dall | 91/314 X |
| 2,239,727 | 4/1941 | Mayer | 91/314 X |
| 2,887,955 | 5/1959 | Owen | 91/314 X |
| 2,977,040 | 3/1961 | Dulebohn | 417/393 X |

*Primary Examiner*—Leonard E. Smith

*Attorney, Agent, or Firm*—Pearne, Gordon, Sessions, McCoy, Granger & Tilberry

[57] ABSTRACT

A fluid-operated reciprocating pump having a central housing, a pair of chamber housings attached to opposite sides of the central housing, and a pumping diaphragm in each chamber housing that separates an inner pressure chamber from an outer pressure chamber. Each outer pressure chamber is connected to an inlet manifold and a discharge manifold, and one-way check valves control the flow of the material being pumped through the chamber. The pumping diaphragms are connected together by a connecting rod that extends through the central housing. The central housing defines inlet and outlet ports for operating fluid, a reversing valve chamber, a pilot valve chamber, and passages connecting the reversing valve chamber to the pilot valve chamber, the inlet port and the inner pressure chambers. A reversing valve is slidably mounted in the reversing valve chamber to control the supply of operating fluid to alternate from one inner chamber to the other, and a pilot valve is slidably mounted in the pilot valve chamber to control the movement of the reversing valve. The pilot valve is controlled by a pair of lever assemblies engaged and pivoted by the connecting rod and located within the central housing.

3 Claims, 6 Drawing Figures

FLUID-OPERATED RECIPROCATING PUMP

BACKGROUND OF THE INVENTION

This invention relates to fluid-operated, reciprocating pumps, and especially to double-diaphragm-type pumps that utilize a reversing valve to control the reciprocating, pumping action. More particularly, the invention relates to the operation of a pilot valve for controlling the reversing valve.

This invention also relates to the inventions of my copending U.S. patent application Ser. No. 415,474, filed Sept. 7, 1982, and the disclosure thereof is incorporated by reference herein and made a part hereof.

Fluid-operated pumps, such as diaphragm pumps, are widely used particularly for pumping liquids, solutions, viscous materials, and slurries or suspensions. The word "liquid" as used herein is intended to include all such materials. Typical diaphragm pumps of this general type are shown in my earlier U.S. patents listed below:

U.S. Pat. No. 3,304,126
U.S. Pat. No. 3,782,863
U.S. Pat. No. 3,514,227
U.S. Pat. No. 3,814,548
U.S. Pat. No. 3,741,689
U.S. Pat. No. 3,860,034
U.S. Pat. No. 3,741,692

Other double-diaphragm pumps are shown in the patents listed below:

U.S. Pat. No. 2,625,886
U.S. Pat. No. 3,652,187
U.S. Pat. No. 2,679,209
U.S. Pat. No. 3,791,768
U.S. Pat. No. 2,780,177
U.S. Pat. No. 3,838,946
U.S. Pat. No. 3,192,865
U.S. Pat. No. 4,019,838
U.S. Pat. No. 3,338,171
U.S. Pat. No. 4,123,204
U.S. Pat. No. 3,548,716
U.S. Pat. No. 4,172,698

Double-diaphragm pumps of the type disclosed in the above-listed prior art patents are well known for their utility in pumping thickened or solids-laden liquids, as well as for pumping plain water, other liquids, and low-viscosity solutions based on such liquids. Accordingly, double-diaphragm pumps have found extensive use in pumping out sumps, shafts, and pits, and generally in handling a great variety of slurries, sludges, and waste-laden liquids. Pneumatically-driven diaphragm pumps offer certain further advantages in convenience, effectiveness, portability, and safety. In pumps of this type, the cylindrical casing of the pump is normally mounted in a substantially horizontal position, the diaphragms are disposed vertically, the connecting rod between them moves back and forth in a substantially horizontal direction, both diaphragms communicate with intake and discharge ports, and the air exhaust line vents to atmosphere. Double-diaphragm pumps are rugged and compact and, to gain maximum flexibility, are often served by a single intake line and deliver liquid through a short manifold to a single discharge line.

While most double-diaphragm pumps of the prior art are operated pneumatically, others are hydraulically operated where the circumstances are suitable. The capability for operating such pumps with other than air pressure is highly desirable, such as where suitable compressors are not available. One very simple source of operating fluid is the water obtainable from a local water utility line where the pressure head is normally between 60 and 100 feet. In many situations, the water at line pressure can be readily used and the exhausted water collected and used locally for various purposes.

SUMMARY OF THE INVENTION

It is among the objects of the present invention to simplify and improve the operation of a pilot valve for controlling the reversing valve used in a double-diaphragm-type pump of the type described.

These and other objects and advantages are achieved by the fluid-operated reciprocating pump construction of the invention, the pump including as basic components a central housing, a pair of chamber housings each disposed at an opposite side of the central housing, and a pair of diaphragms, one in each of the chamber housings and dividing the interior of each chamber housing into inner and outer pressure chambers. The outer pressure chambers are connected to inlet and discharge manifolds, and one-way check valves are provided to control the flow through the pump. The pumping members or diaphragms are connected together by a connecting rod for synchronized reciprocating movement in their respective chambers, and the connecting rod extends through the central portion of the central housing.

The central housing defines inlet and outlet ports for operating fluid, a reversing valve chamber, a pilot valve chamber, and passages connecting the reversing valve chamber to the pilot valve chamber, the inlet port, and the inner pressure chambers. A reversing valve is slidably mounted in the reversing valve chamber to control the supply of operating fluid to alternate from one inner chamber to the other, and a pilot valve is slidably mounted in the pilot valve chamber to control the movement of the reversing valve. The pilot valve comprises an elongated, spool-type element adapted for reciprocating linear movement in a direction generally perpendicular to the direction of movement of the connecting rod and is controlled by a member associated with the connecting rod and located within the central housing.

In accordance with the invention, pilot valve operating levers mounted in the central housing are operated by the connecting rod, and are adapted alternatingly to engage the pilot valve to shift it between its operating positions in response to reciprocating movement of the flexible pumping diaphragms.

DESCRIPTION OF THE PREFERRED EMBODIMENT

Figure 1:
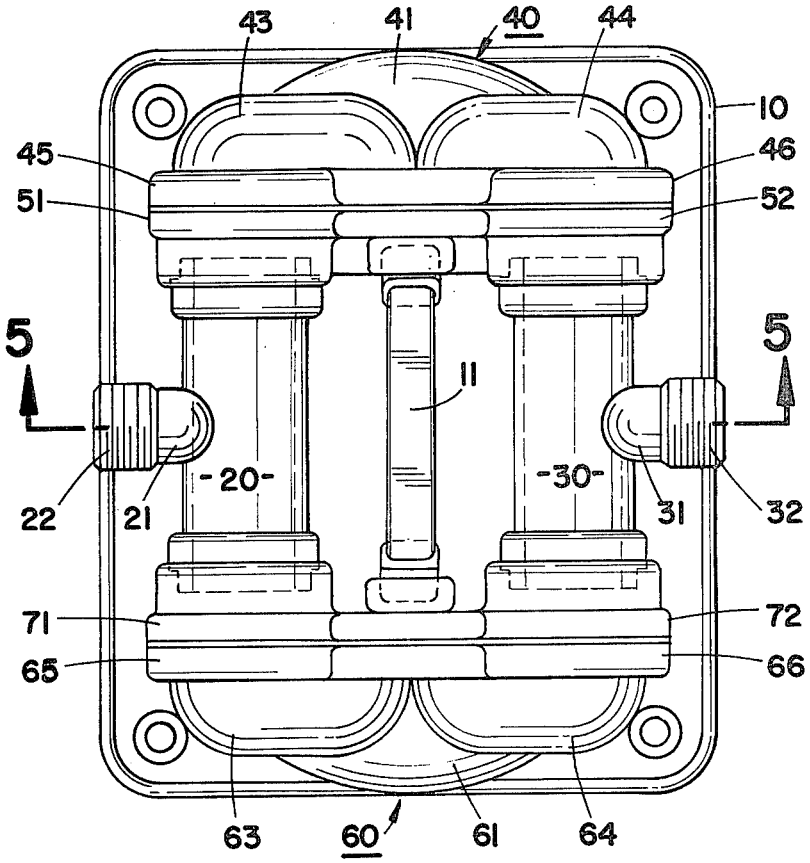
FIG. 1 is a plan view of a double diaphragm pump embodying the invention.
Figure 2:
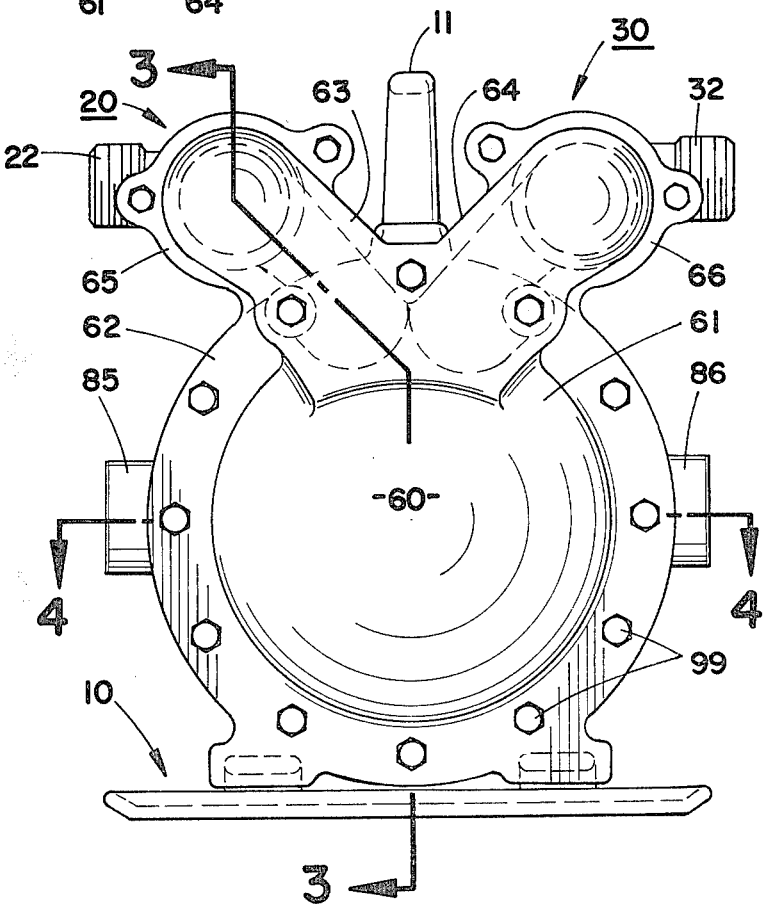
FIG. 2 is an end elevation of the double diaphragm pump of FIG. 1.

Referring more particularly to the drawings, there is shown a double-diaphragm pump embodying the invention and adapted to pump a liquid, slurry, suspension, or other flowable material. For the purpose of illustration, the doublediaphragm pump to be shown and described uses a liquid under pressure or compressed air as the source of pumping fluid, such as water from an outlet tap in a standard water utility system or compressed air from a compressor.

The pump is mounted on a flat base 10, and includes as basic components an inlet manifold 20 and an outlet manifold 30 for the material being pumped, a pair of identical chamber housings 40 and 60, and a central housing 80. The chamber housings 40 and 60 and central housing 80 may be formed of a molded plastic material such as Delrin or other moldable engineering grade plastic.

The inlet manifold 20 has an inlet 21, with a conventional fitting 22 to permit connection to a flexible water hose, for example. Also, one-way check valves 25 and 26 (see FIG. 3) are located at opposite ends of the inlet manifold 20 to control the flow of fluid through the pump during the reciprocating movement.

The outlet manifold 30 has an outlet 31 with a fitting 32 for accommodating an outlet conduit such as a water hose. Also, the manifold 30 has one-way check valves, similar to valves 25 and 26, to control the fluid flow during the pumping strokes.

While various types of one-way valves may be successfully used in the pump, as will be apparent to those skilled in the art, the particular one-way valves 25 and 26 shown herein are novel, specially designed valves that are described and shown in my copending U.S. patent application Ser. No. 21,494, filed May 17, 1982.

The chamber housings 40 and 60 are essentially identical. The various parts thereof are numbered consecutively in identical order, the parts of housing 40 starting with number 41 and the parts of housing 60 starting with number 61. Each housing has an outer wall member 41 and 61 (FIG. 3), with a radial mounting flange 42 and 62, a radially extending inlet duct 43 and 63, and an adjacent radially extending outlet duct 44 and 64. Each inlet duct 43 and 63 has a mounting flange 45 and 65 and, likewise, each outlet duct 44 and 64 has a radial flange 46 and 66.

Each chamber housing 40 and 60 also has an inner wall member 49 and 69, with a radial flange 50 and 70 and with a pair of radial extensions 51 and 52, 71 and 72 that cooperate with the inlet and outlet ducts 43, 44, 63, and 64 of the outer wall members 41 and 61.

Each extension 51 and 71 has a mounting flange 53 and 73 and, likewise, each radial extension 52 and 72 has a mounting flange 54 and 74.

Each chamber housing has a flexible diaphragm 55 and 75 mounted therein, with its circumferential portion clamped between the flanges 42 and 50 on the one hand and 62 and 70 on the other hand. The flexible diaphragms 55 and 75 separate their respective chamber housings 40 and 60 into outer pressure chambers 56 and 76 and inner pressure chambers 57 and 77. The outer pressure chambers 56 and 76 communicate with the inlet and outlet ducts 43, 63, and 44 and 64, respectively.

The inner wall members 49 and 69 each have a port 58 and 78 through which pumping fluid enters and is exhausted. Also, the wall members 49 and 69 each have a central opening 59 and 79 formed therein for the connecting rod assembly that connects the diaphragms 55 and 75 together for alternating pumping strokes.

The housing 80 is generally tubular and has radial flanges 83 and 84 at its opposite ends that cooperate with the radial flanges 42, 62, 50 and 70 of the chamber housings 40 and 60 to provide for the connection of the chamber housings 40 and 60 to the central housing, and thus to one another, to complete the assembly.

Figure 5:
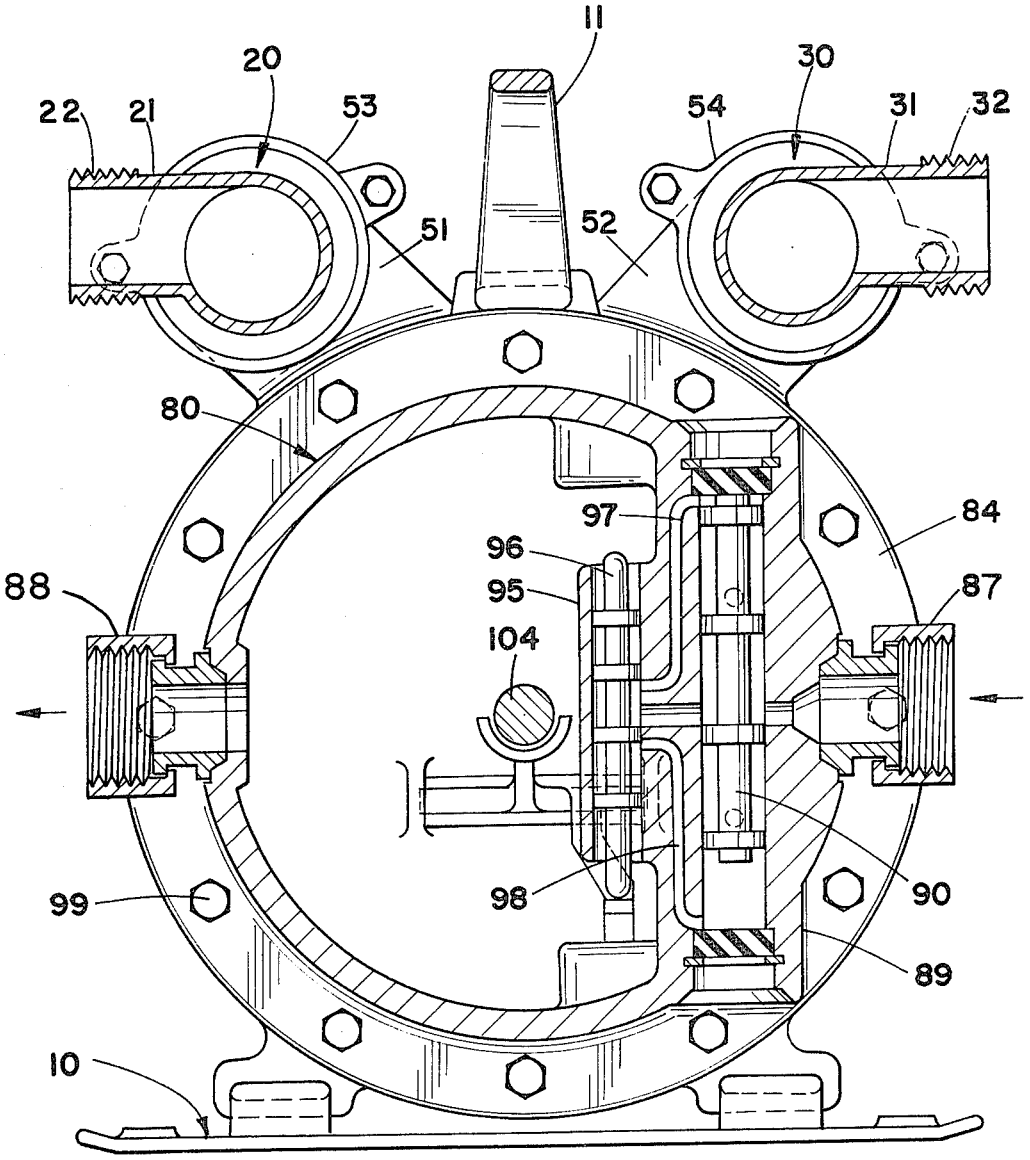
FIG. 5 is a sectional view, taken on the line 5—5 of FIG. 1.
Figure 6:
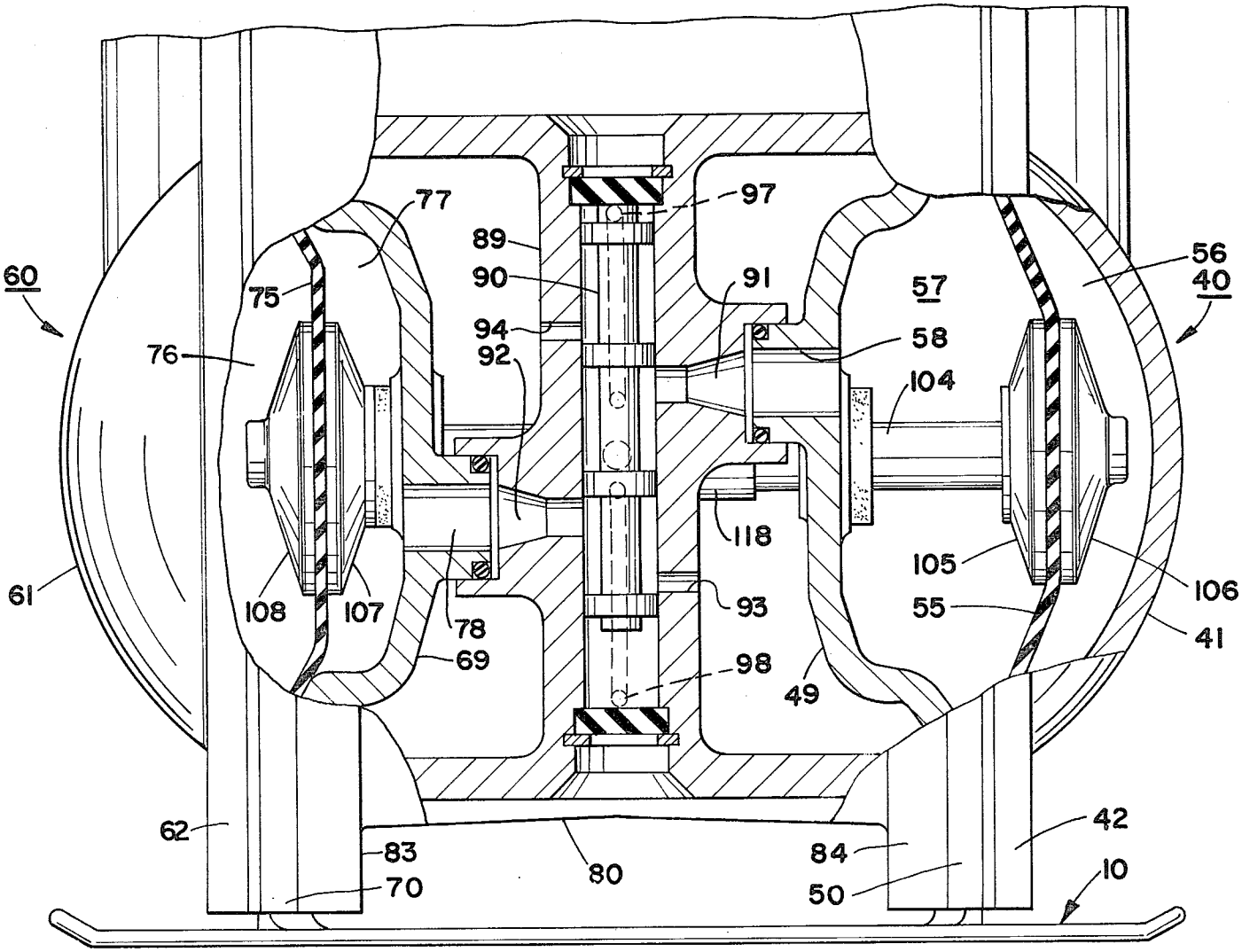
FIG. 6 is a side elevational view on an enlarged scale, with parts broken away to show the reversing valve.

The resulting central housing 80 defines a fluid inlet 85 at one side and a fluid outlet 86 at the opposite side, the inlet 85 being provided with an inlet fitting 87 and the outlet 86 likewise being provided with an outlet fitting 88. The fittings 86 and 88 may be conventional hose connectors for conventional garden hoses. Inside, the housing 80 defines a reversing valve housing 89 (FIG. 5) for a reversing valve 90 that is adapted for reciprocating sliding movement in its housing 89 to control the alternating supply of pumping fluid to the inner pressure chambers 57 and 77. Also, the housing 80 defines fluid passages 91 and 92 communicating with the fluid ports 58 and 78 for the inner pressure chambers 57 and 77, as well as exhaust ports 93 and 94 through which pumping fluid is exhausted to the interior space in the central housing 80.

Adjacent the reversing valve housing 89 is a pilot valve housing 95 for a pilot valve 96 that reciprocates therein in response to movement of the flexible diaphragms 55 and 75. A pair of pilot passages 97 and 98 communicate between the pilot valve housing 95 and the reversing valve housing 89 in order to effect control of the reversing valve 90 by the pilot valve 96, as will be readily apparent to those skilled in the art. The chamber housings 40 and 60 are secured to the central housing 80 by bolts 99 that extend through the respective flanges 42, 50, and 83 on the one hand and 62, 70, and 84 on the other hand, the bolts being uniformly spaced around the circumference of the central housing 80.

As indicated below, the flexible diaphragms 55 and 75 are connected to one another by a connecting rod assembly 100 that extends through the central housing 80 and reciprocates back and forth therein. The connecting rod assembly 100 comprises a rod 101 with ends 102 and 103 and an enlarged central portion 104. The shoulder at one end of the central portion 104 bears against a retainer plate 105, which, together with another retainer plate 106, serves to clamp the diaphragm 55 therebetween. The threaded end 103 is threadedly received in the retainer plate 106, as indicated in FIGS. 3 and 4.

Figure 3:
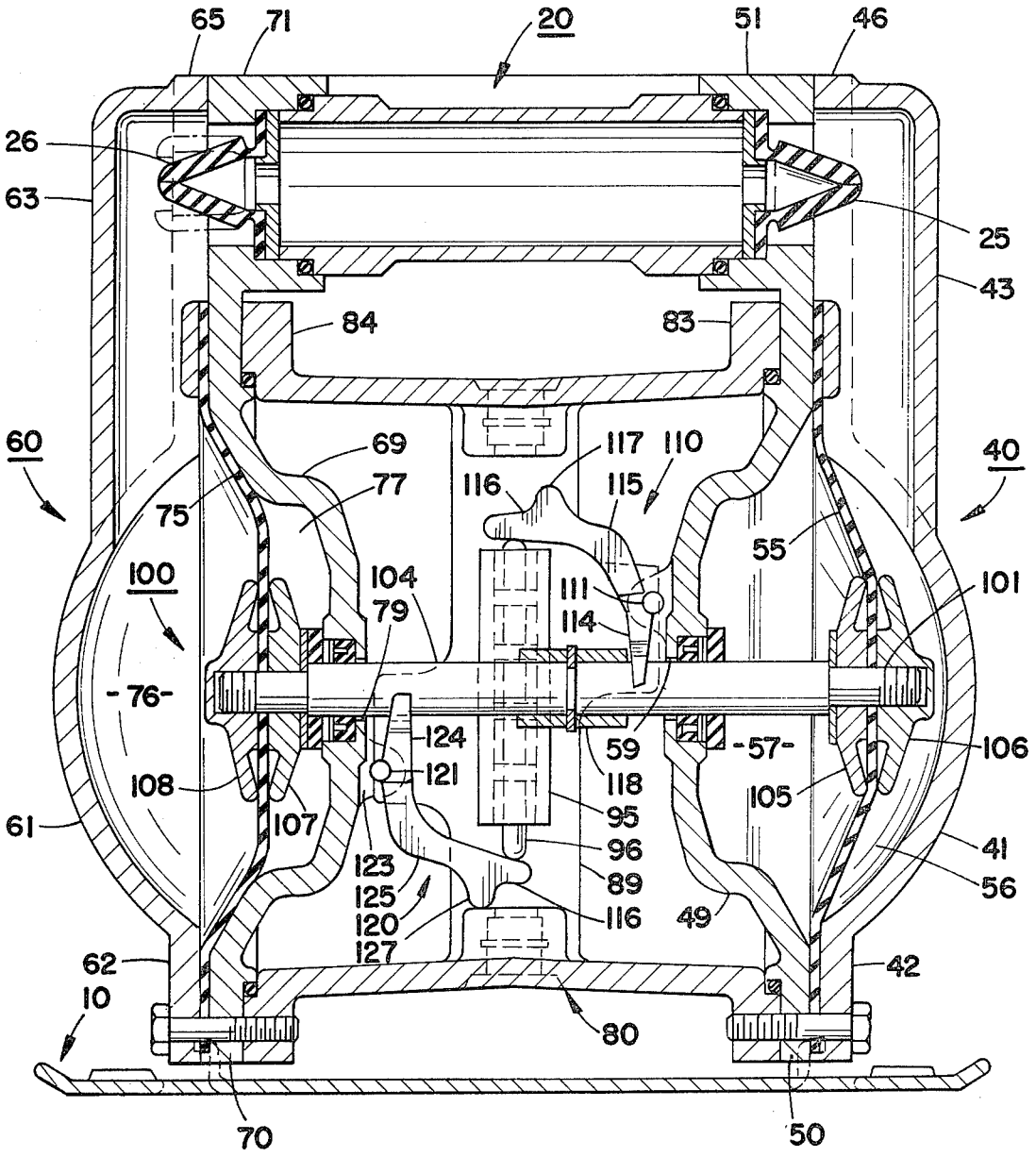
FIG. 3 is a sectional view, taken on the line 3—3 of FIG. 2.
Figure 4:
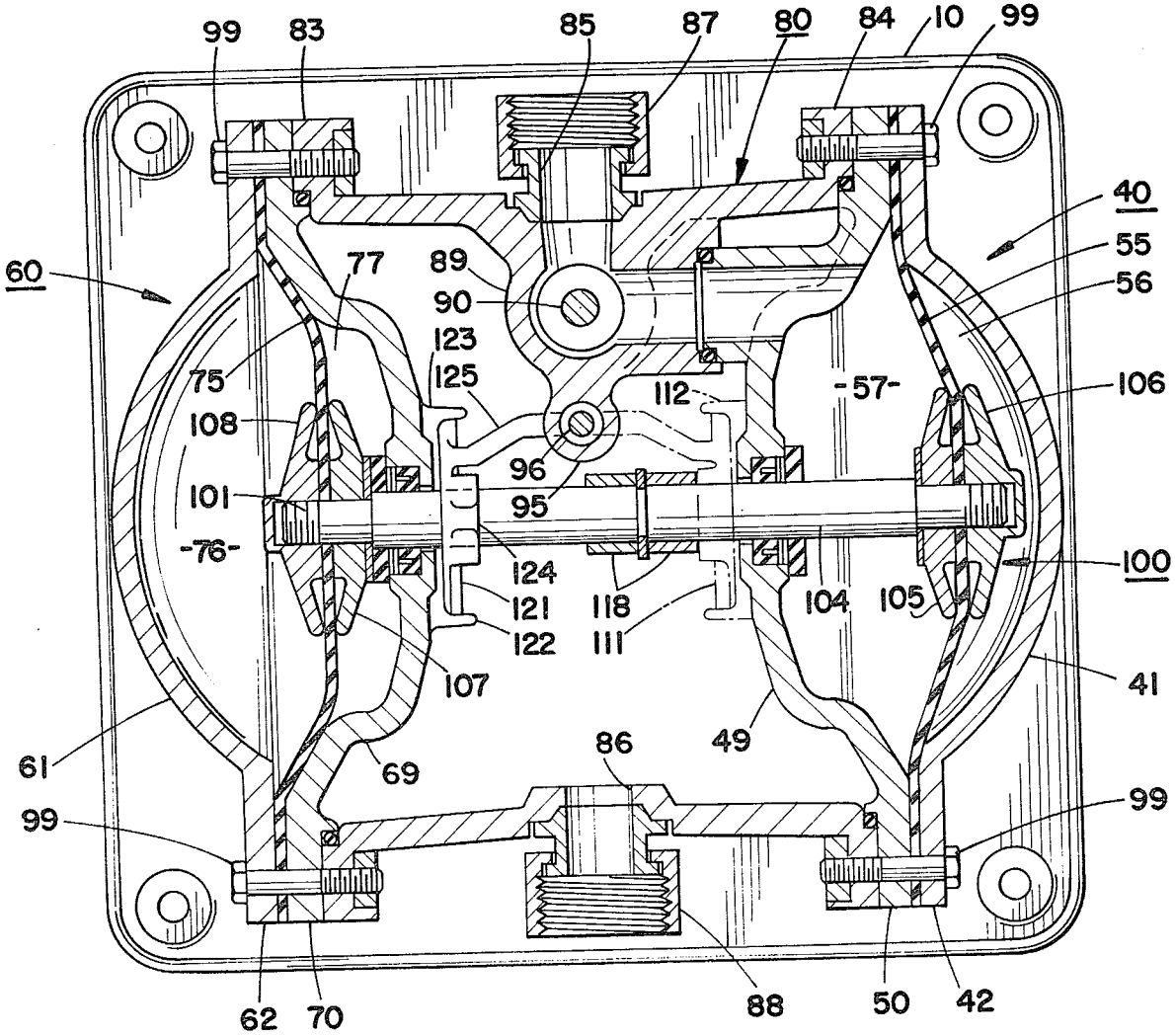
FIG. 4 is a sectional view, taken on the line 4—4 of FIG. 2.

The shoulder at the other end of the central portion 104 bears at the other end against a retainer plate 107, which, together with a retainer plate 108, clamps the flexible diaphragm 75 therebetween, as indicated in FIGS. 3 and 4. The plates 105, 106, 107, and 108 assure that the flexing of the diaphragms 55 and 75 occurs in a circular zone spaced outwardly from the center of the respective diaphragms to better distribute flexing loads.

The pilot valve 96 is controlled by means of a pair of lever assemblies 110 and 120 mounted in the central housing 80 on opposite sides of the connecting rod assembly 100, as best shown in FIGS. 3 and 4. The lever assemblies 110 and 120 are essentially identical. The various parts thereof are numbered consecutively in identical order, the parts of the lever assembly 110 starting with the numeral 111 and the parts of the lever assembly 120 starting with the numeral 121.

Each lever assembly has an axle 111, 121 that serves to pivotally mount the assembly 110, 120 in brackets 112, 113 and 122, 123 formed integrally with the housing 80. One arm 114, 124 has a bifurcated end that is positioned partly around and closely spaced from the surface of the rod 101. The other arm 115, 125 extends in a more radially outward direction relative to the rod 101 to a position wherein it is adapted to engage an end of the pilot valve 96.

As indicated in FIG. 4, the arm 115, 125 has a bend formed therein so that the outer end 116, 126 extends over the ends of the valve 96 to provide suitable operating engagement. It will be apparent that pivotal movement of the lever assemblies 110 and 120 will result in engagement and shifting of the valve between its two positions. The outward extension of the valve 96 is controlled by a stop 117, 127 formed on the arm 115, 125 to limit the pivotal movement of the lever assembly 110, 120, and thus the extended position of the valve.

The lever assemblies 110 and 120 are pivoted by means of a sleeve 118 that is keyed to the rod 101 and that moves back and forth with the rod into alternating engagement with the arms 114 and 124. Movement of the rod in one direction, such as to the right as shown in FIG. 3, results in engagement with the arm 114 and resultant pivoting of the arm 115 in a counterclockwise direction to force the valve 96 to the position shown. The movement of the rod 101 in the opposite direction or to the left releases the arm 114 and results in engagement and counterclockwise pivoting of the arm 124 of the lever assembly 120 to pivot the arm 126 in a counterclockwise direction and shift the valve 96 to its opposite position.

Operation

As indicated above, the double diaphragm pump of the invention is capable for use with either gas or liquid as the pumping fluid; however, the particular pump herein shown and described is adapted to be operated by water supplied from a public water system. Preferably, the water is supplied and exhausted through typical garden hoses or the like so that the pump may be located in any temporary location. The water under pressure enters through the fluid inlet fitting 87 and from there enters the reversing valve chamber. The reversing valve controls the flow of water through one or the other of the fluid passages 91 and 92 to one or the other of the inner pressure chambers 57 and 77, where the pressure forces the respective flexible diaphragm 55 or 75 in an outward direction and, at the same time, draws the opposite diaphragm 55 or 75 in the opposite or inward direction. During this movement, the connecting rod assembly 100 engages and pivots the respective operating lever assembly 110, 120, which in turn engages the outwardly extending end of the pilot valve 96 and forces it in the opposite direction. This movement ultimately causes fluid pressure to be applied to one end of the reversing valve chamber and begins to force the reversing valve in the opposite direction. Ultimately, the reversing valve changes the porting so that fluid pressure is applied to the opposite inner pressure chamber and fluid in the formerly expanded chamber is exhausted through the reversing valve housing to the space within the central housing 80.

From the interior of the central housing 80, the fluid is exhausted through the fluid outlet 86.

The resulting movement of the flexible diaphragms 55 and 75 results in the pumping of liquid material to be pumped through the outer pressure chambers 56 and 76 in an alternating manner, the inlet and exhaust of liquid through the manifolds 20 and 30 being controlled by the one-way valves, as will be readily apparent to those skilled in the art.

While the invention has been shown and described with respect to a specific embodiment thereof, this is intended for the purpose of illustration rather than limitation, and other modifications and variations of the specific device herein shown and described will be apparent to those skilled in the art all within the intended spirit and scope of the invention. Accordingly, the patent is not to be limited in scope and effect to the specific embodiment herein shown and described, nor in any other way that is inconsistent with the extent to which the progress in the art has been advanced by the invention.

What is claimed is:

1. In a fluid-operated pump including:

a central housing;

a pair of chamber housings disposed at opposite ends of said central housing;

a pair of pumping members, one in each of said chamber housings and dividing the interior of said chamber housings into inner and outer pressure chambers;

inlet and discharge means disposed to communicate with said outer pressure chambers;

a connecting rod connecting said pumping members together for common reciprocatory movement in their respective chamber housings;

said central housing defining inlet and outlet ports and passage means connecting said inlet and outlet ports to said inner chambers, said passage means including a reversing valve chamber and a pilot valve chamber, said inlet port being adapted for connection to a source of fluid under pressure and a reversing valve movably mounted in said reversing valve chamber for controlling the supply of said fluid under pressure to alternate from one inner chamber to another; the improvement which comprises:

pilot valve means movably mounted in said pilot valve chamber for controlling the movement of said reversing valve, said pilot valve means comprising an elongated valve member adapted for reciprocating linear movement in a direction perpendicular to the direction of movement of said connecting rod, the axis of said valve member being in a central plane centered between said chamber housings;

a pair of lever means in said central housing for operating said pilot valve means, each mounted for pivotal movement about an axis, said axes being located on opposite sides of said central housing spaced from and generally perpendicular to said connecting rod and to said pilot valve member, and means on said connecting rod for alternately engaging and pivoting said lever means about their respective axes, each lever means having an arm engageable with an end of said valve member for shifting said valve member from one position to another in response to reciprocating movement of said connecting rod.

2. A fluid-operated pump as defined in claim 1, wherein said connecting means comprises a rigid rod.

3. A fluid-operated pump as defined in claim 1, wherein each lever means comprises an axle journaled at its ends in said central housing, a first lever arm extending from said axle to an end of said valve member and adapted to engage an end of and move said valve member when pivoted in one direction and a second lever arm extending from said axle generally along a line that intersects the axis of said connecting means, whereby said means on said connecting means engages and pivots said second arm in response to movement of said connecting means.

* * * * *